US008464458B2

(12) United States Patent
Chvala

(10) Patent No.: US 8,464,458 B2
(45) Date of Patent: Jun. 18, 2013

(54) FOLDABLE AND ADJUSTABLE FIREARM STOCK ASSEMBLY

(75) Inventor: John R. Chvala, Grafton, WI (US)

(73) Assignee: Advanced Technology International USA, LLC, Milwaukee, WI (US)

( * ) Notice: Subject to any disclaimer, the term of this patent is extended or adjusted under 35 U.S.C. 154(b) by 95 days.

(21) Appl. No.: 13/208,534

(22) Filed: Aug. 12, 2011

(65) Prior Publication Data

US 2013/0036645 A1 Feb. 14, 2013

(51) Int. Cl.
*F41C 23/00* (2006.01)

(52) U.S. Cl.
USPC ..... 42/73

(58) Field of Classification Search
USPC ..... 42/71.01, 71.02, 72, 73, 74, 75.03
See application file for complete search history.

(56) References Cited

U.S. PATENT DOCUMENTS 2,400,349 A * 5/1946 Haberstump ..... 42/72
3,256,632 A * 6/1966 Beretta ..... 42/72
3,618,249 A * 11/1971 Grandy ..... 42/73
3,798,819 A 3/1974 Hillberg
4,735,007 A * 4/1988 Gal ..... 42/72
4,788,785 A * 12/1988 White ..... 42/72
4,887,374 A * 12/1989 Santarossa ..... 42/73
7,698,848 B1 * 4/2010 Bentley ..... 42/73
7,827,721 B2 11/2010 Griffin

* cited by examiner

*Primary Examiner* — Gabriel Klein
(74) *Attorney, Agent, or Firm* — Andrus, Sceales, Starke & Sawall, LLP

(57) ABSTRACT

A pivotable and length adjustable firearm stock assembly includes a pivot stock having one end provided with a combined pivoting and latching arrangement movable about a horizontal pivot axis and adapted to be pivotally mounted on a rear end of the firearm. An opposite end is provided with a slide member having a lock receiving structure. A butt stock has one end slidably mounted on the slide member, and an opposite end provided with a butt plate pivotally mounted thereto. A movable member is interconnected between the pivot stock and the butt stock for locking the butt stock in various axial adjustment positions relative to the slide member of the pivot stock. The pivot stock and the butt stock together are movable about the horizontal pivot axis between a folded position and an unfolded position, and the butt stock is slidably adjustable relative to the pivot stock between various collapsed and extended positions.

18 Claims, 7 Drawing Sheets

FOLDABLE AND ADJUSTABLE FIREARM STOCK ASSEMBLY

BACKGROUND OF THE INVENTION

The present disclosure relates generally to firearms and, more particularly, pertains to a variably configurable firearm stock assembly to facilitate firearm grip and handling.

There has been a longstanding recognition as to the desirability of firearms in which the stock can be moved between folded and unfolded, as well as between collapsed and extended positions. Such positions are useful during transport, storage and use of firearms, and are particularly advantageous in certain tactical situations.

Folding stocks are characterized by a stock assembly pivotably mounted on a rear end of a firearm between a folded storage position lying over the top or side of the firearm, and an unfolded operative position in which the stock assembly is moved to a shoulder-engaging orientation extending rearwardly from the firearm. Sliding stocks are known to have a stock assembly in which a butt stock is slidably adjustable along a fixed member between one or more rearward collapsed and extended positions.

Attempts have been made to advance functionality of the stock assembly to include various folding and/or sliding configurations, but have generally been found not to be reliable and durable over repeated operation. Previous variably configurable stock assemblies have been unsatisfactory due to, among other things, numerous pieces or parts, unreliable transition and occasional jamming between configurations, and creating interference in operating the firearm.

Accordingly, there remains a need to provide a stock assembly which incorporates, in one integrated design, an enhanced folding and length adjustable combination which overcomes the shortcomings of previous devices.

SUMMARY OF THE INVENTION

The present disclosure relates to a pivotable and length adjustable firearm stock assembly including a pivot stock having one end provided with a combined pivoting and latching arrangement movable about a horizontal pivot axis and adapted to be pivotably mounted on a rear end of a firearm. The pivot stock has an opposite end provided with a slide member having lock receiving structure. A butt stock has one end slidably mounted on the slide member, and an opposite end provided with a butt stock pivotably mounted thereto. A movable member having lock structure thereon is interconnected between the pivot stock and the butt stock for locking the butt stock in various axial adjustment positions relative to the slide member of the pivot stock. The pivot stock and the butt stock together are movable about the horizontal pivot axis between a folded position adapted to lie adjacent the firearm, and an unfolded position adapted to lie rearwardly of the firearm. The butt stock is slidably adjustable relative to the pivot stock between various collapsed and extended positions. The pivoting and latching arrangement is both pivotable about and axially movable along the horizontal pivot axis.

The present disclosure also relates to a pivotable and length adjustable firearm stock assembly including a pivot stock having one end provided with a combined pivoting and latching arrangement pivotably mounted about a horizontal pivot axis on a rear end of a firearm. The pivot stock has an opposite end provided with a slide member having lock receiving structure formed thereon. A butt stock has one end slidably mounted for axial movement on a slide member, and an opposite end provided with a butt plate pivotally mounted thereto. An elongated lever has lock structure thereon engageable and disengagable with the lock receiving structure on the slide member. The lever is pivotably mounted on the butt stock and has a front portion provided with the lock structure, and an opposite rear portion controllable to selectively effect engagement and disengagement of the lock structure relative to the lock receiving structure so as to enable various axial adjustment positions of the butt stock relative to the pivot stock.

The lock structure is comprised of a lever detent, and the lock receiving structure is comprised of a set of detent receiving recesses. The rear portion of the firearm includes a pistol grip assembly. The slide member is matingly and non-rotatably received within an interior surface of the butt stock. The front portion of the lever extends beyond the one end of the butt stock. The rear portion of the lever is located adjacent the opposite end of the butt stock. The lever is pivotally mounted between spaced sidewalls of the butt stock. A spring is disposed between the rear portion of the lever and the butt stock adjacent the opposite end thereof. The spring is biased to normally hold the lever detent engaged with the one of the detent receiving recesses. Movement of the lever against bias of the spring releases the lever detent from the one of the detent receiving recesses, and enables the butt stock to slide upon the pivot stock and the detent to be engaged with another of the detent receiving recesses.

The present disclosure further relates to a firearm stock assembly including a pivot stock having one end provided with a combined pivoting and latching arrangement pivotably mounted upon a horizontal pivot axis on a rear portion of a firearm. The pivot stock has an opposite end with a fixed mounting member projecting therefrom. A butt stock is attached to the fixed mounting member. The pivot stock and the butt stock together are movable about the horizontal pivot axis between a folded position lying adjacent the firearm and an unfolded position extending rearwardly of the firearm. The rear portion of the firearm includes a latch engaging structure cooperable and continuously engageable with a latch member of the pivoting and latching arrangement as the pivot stock and the butt stock move together about the horizontal pivot axis to define a first locking position for preventing movement of the pivot stock and the butt stock from the folded position, and a second locking position for preventing movement of the pivot stock and the butt stock from the unfolded position.

The latch engaging structure is defined by a pair of latch engaging recesses interconnected by a grooved track for guiding the latch member between the latch engaging recesses. One of the latch engaging recesses defines a first locking position, and the other of the latch engaging recesses defines the second locking position. The track defines a curved path that is concentric relative to the horizontal pivot axis. The track has a ramped cam surface that slopes between the pair of latch engaging recesses. The rear portion of the firearm includes a throughbore having the horizontal pivot axis passing therethrough, and the one end of the pivot stock includes a pair of spaced apart side arms engaged with side surfaces of the rear portion and having holes in registration with the throughbore. The latch member is positioned on one of the side arms and includes a latch detent eccentrically located relative to a central aperture of the latch member.

The pivoting and latching arrangement includes a tube structure positioned in the throughbore, and a plunger slidably inserted for movement in the tube structure along the horizontal pivot axis. The plunger has an outer depressible end accessible from the other of the side arms, and an inner end connected to the latch member positioned on the one of the side arms. A spring is disposed between the plunger and the tube structure and is biased to normally hold the latch detent in one of the first and second locking positions. Movement of the plunger along the horizontal pivot axis against the bias of the spring moves the latch member away from the one side arm, and releases the latch detent from the one of the first and second locking positions allowing the pivot stock connected to the butt stock to pivot about the horizontal pivot axis and the latch detent to travel along the track towards the other of the first and second locking positions.

BRIEF DESCRIPTION OF THE DRAWINGS

The drawings illustrate the best mode presently contemplated in carrying out the disclosure. In the drawings.

DETAILED DESCRIPTION OF THE INVENTION

Figure 1:
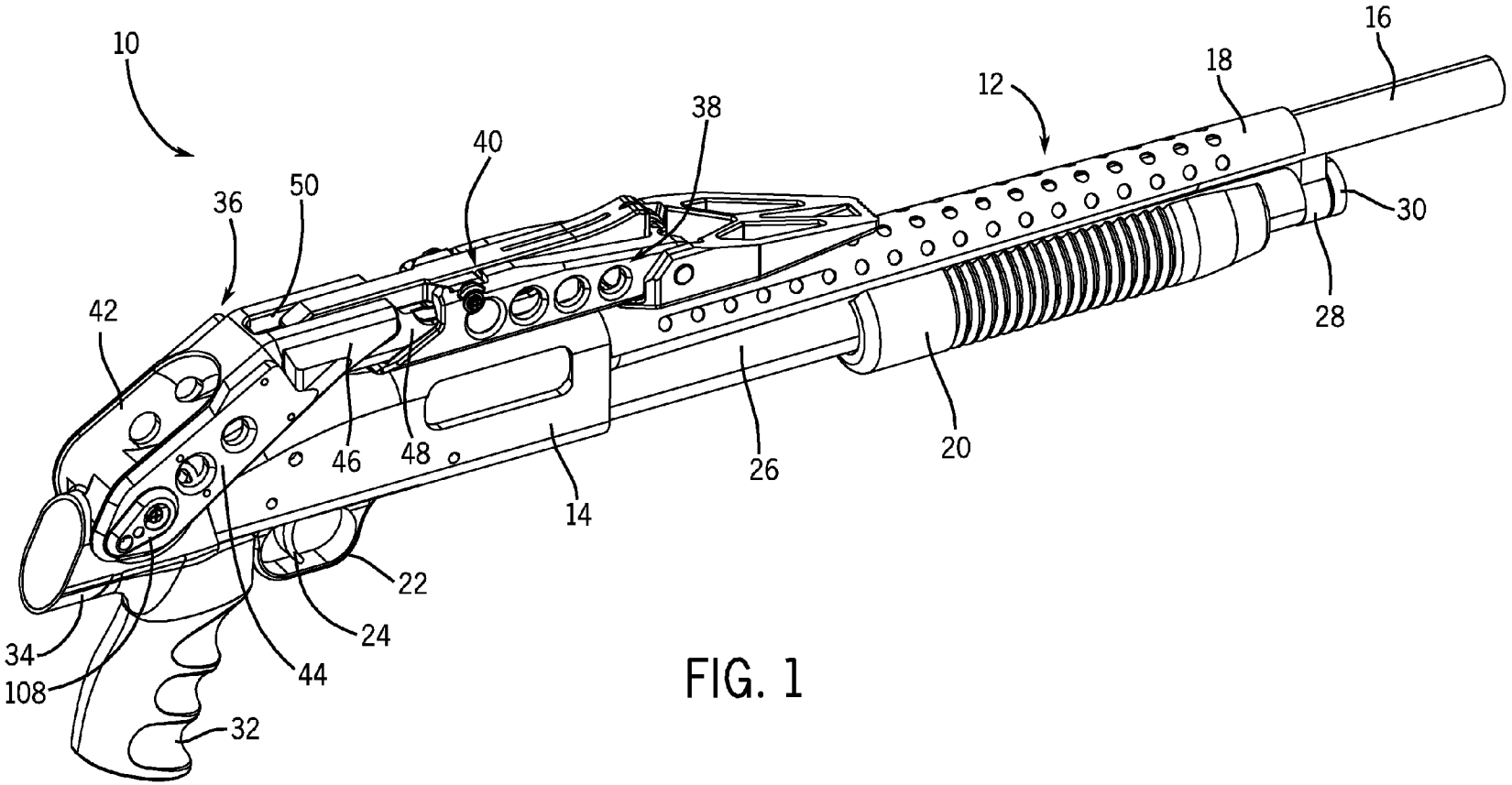
FIG. 1 is a perspective view of one side of a shotgun provided with a pivotable and length adjustable over the top stock assembly shown in a folded position.
Figure 2:
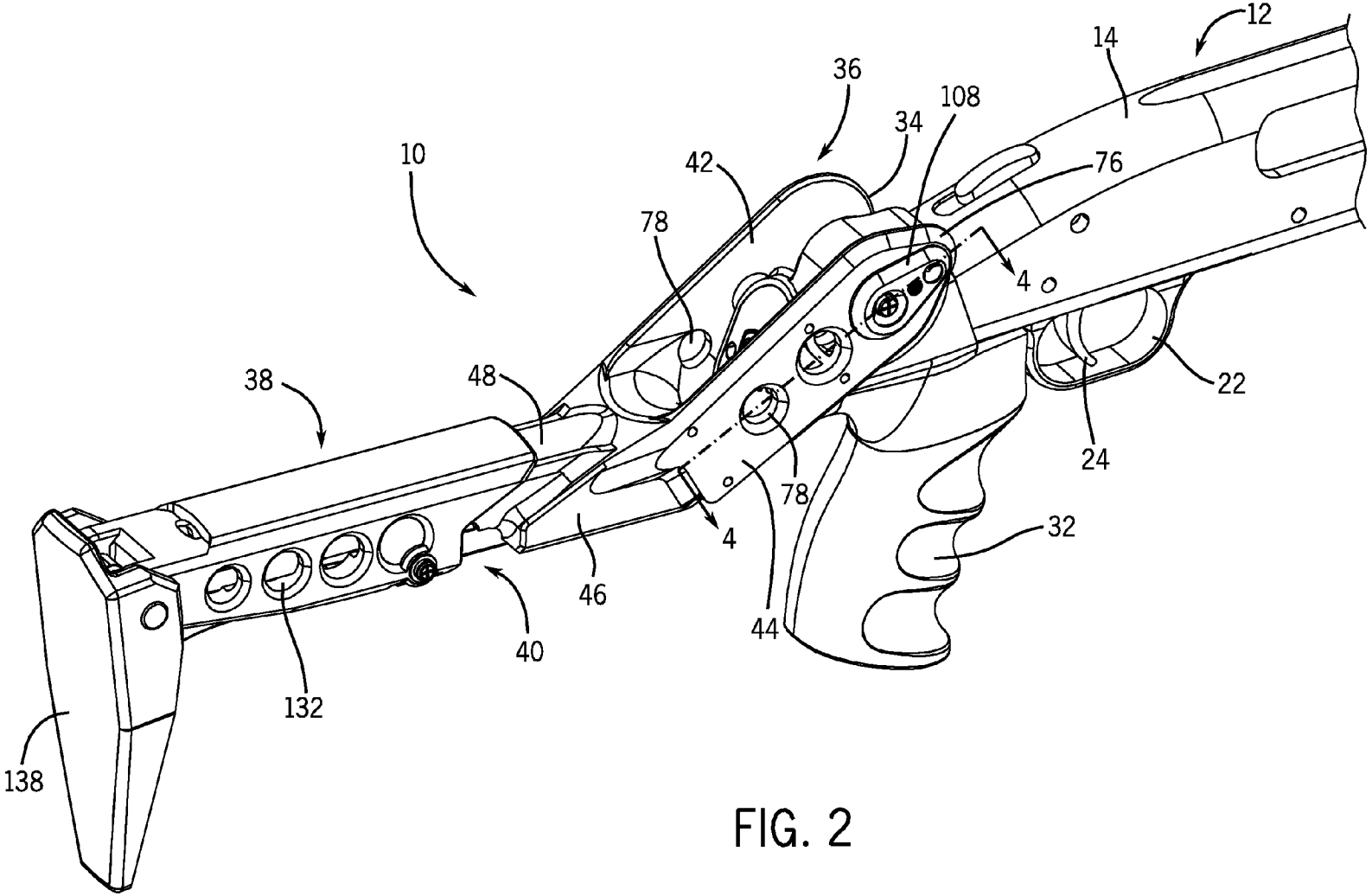
FIG. 2 is an enlarged, fragmentary view of FIG. 1 showing the over the top stock assembly in an unfolded position.

Referring now to the drawings, FIGS. 1 and 2 illustrate an adjustable and lockable over the top stock assembly 10 movably attached relative to a rear portion of a firearm, such as a shotgun 12, between folded and unfolded positions, respectively.

Shotgun 12 typically includes a receiver 14, a barrel 16 having a perforated heat shield 18, a gripping, slidable fore end 20, a trigger guard 22 and a trigger 24. The shotgun 12 shown also includes a cartridge-storing magazine tube 26 that extends longitudinally from the receiver 14 and below the barrel 16. A forward portion of the magazine tube 26 engages a barrel lug 28 and is held thereto by a magazine cap 30. In addition, shotgun 12 is equipped with a pistol grip assembly formed by a pistol grip 32 and a mounting device 34, and connected below and at the rear of the receiver 14.

In accordance with the present disclosure, the over the top stock assembly 10 is pivotably mounted to a pistol grip assembly 32, 34 from the folded position (FIG. 1) over the receiver 14 and the heat shield 18 to the unfolded position (FIG. 2) for supportive engagement with a shooter's shoulder. As will be further explained below, the over the top stock 10 includes a combined pivoting and latching arrangement for locking and unlocking the over the top stock assembly 10 between folded and unfolded positions thereof, and an incremental telescopic or sliding arrangement for selectively adjusting a length of the over the top stock 10 between fully collapsed and variously extended positions.

As also seen in FIGS. 1 and 2, the over the top stock assembly 10 is generally comprised of a pivot stock 36, a butt stock 38 slidably engageable with the pivot stock 36, and an elongated movable member or hand lever 40 provided with lock structure and mounted between the pivot stock 36 and the butt stock 38 to facilitate relative axial adjustment and locking therebetween. Typically, the over the top stock assembly 10 is constructed of a lightweight, durable and rigid material, such as anodized aluminum, which will not add appreciable weight to the shotgun 12, yet will provide the necessary support needed by the user during firing of the shotgun 12.

Figure 7:
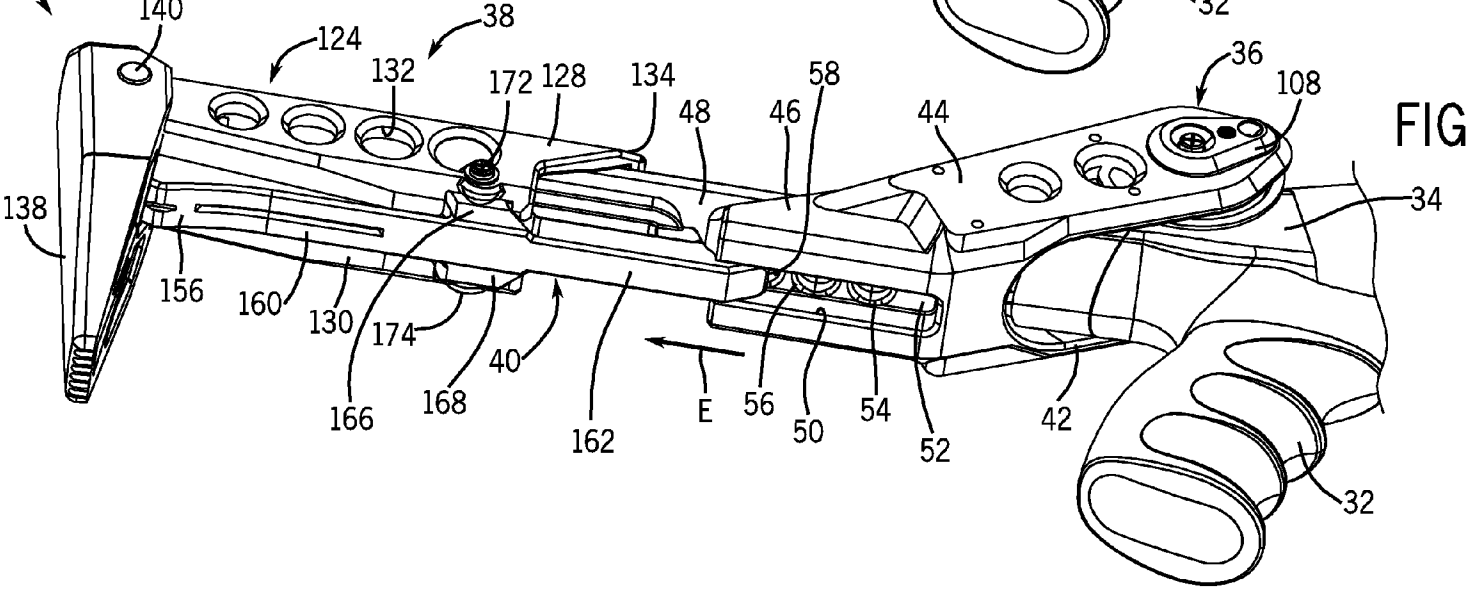
FIG. 7 is a view similar to FIG. 6 depicting a sliding length adjustment of the over the top stock assembly.

The pivot stock 36 includes a bifurcated pivot end defined by a pair of spaced apart side arms 42, 44 that are interconnected by and angularly disposed relative to a bridge portion 46. The bridge portion 46 is integrally formed with an elongated fixed mounting or slide member 48 projecting therefrom, and is configured with a central channel 50 exposing a surface 52 (FIG. 7) of the slide member 48. The surface 52 is provided with a lock receiving structure defined by a series of spaced apart cylindrical, detent receiving recesses 54, 56, 58, 60 (FIGS. 8, 9) which serve to establish different axial adjustment positions for the butt stock 38 as will be more fully understood below.

The side arms 42, 44 are designed to be pivotally mounted to the upper end or mounting device 34 of the pistol grip assembly which is formed with a throughbore 62 (FIG. 4) defining a horizontal pivot axis A passing therethrough. As seen best in FIG. 5, one side of the mounting device 34 outside throughbore 62 is provided with latch engaging structure in the form of two cylindrical latch receiving recesses 64, 66 that are joined by a curved, grooved cam track 68 that slopes or ramps inwardly from recess 64 to recess 66. The cam track 68 defines a curved path that is concentric with the horizontal pivot axis A. Side arm 42 includes a circular hole 70 that is aligned with a circular hole 72 formed in the opposed side arm 44. Both side arm holes 70, 72 are designed to be in registration with throughbore 62 when inner surfaces of the side arms 42, 44 lie against upper side surfaces of the mounting device 34. Side arm 44 is also provided with an additional hole 74 that is formed on an extended end 76 of the side arm 44 which projects beyond a corresponding end of side arm 42. Both holes 72, 74 are located in an eccentrically shaped surface countersunk into the side arm 44. Each of the side arms 42, 44 is configured with a pair of materially-relieved openings 78 for reducing the weight of the stock assembly 10. Although not shown, external surfaces of the side arms 42, 44 may be used as mounting surfaces for carrying auxiliary equipment such as shotgun shell holders or the like.

Figure 3:
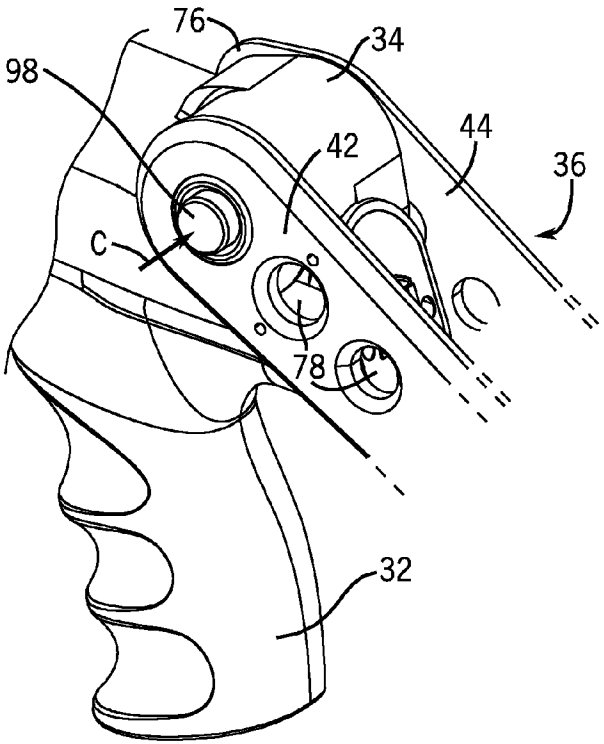
FIG. 3 is a fragmentary perspective view of an opposite side of the shotgun showing a latching arrangement for the over the top stock assembly used in locking and unlocking the stock during pivotable movement thereof.
Figure 4:
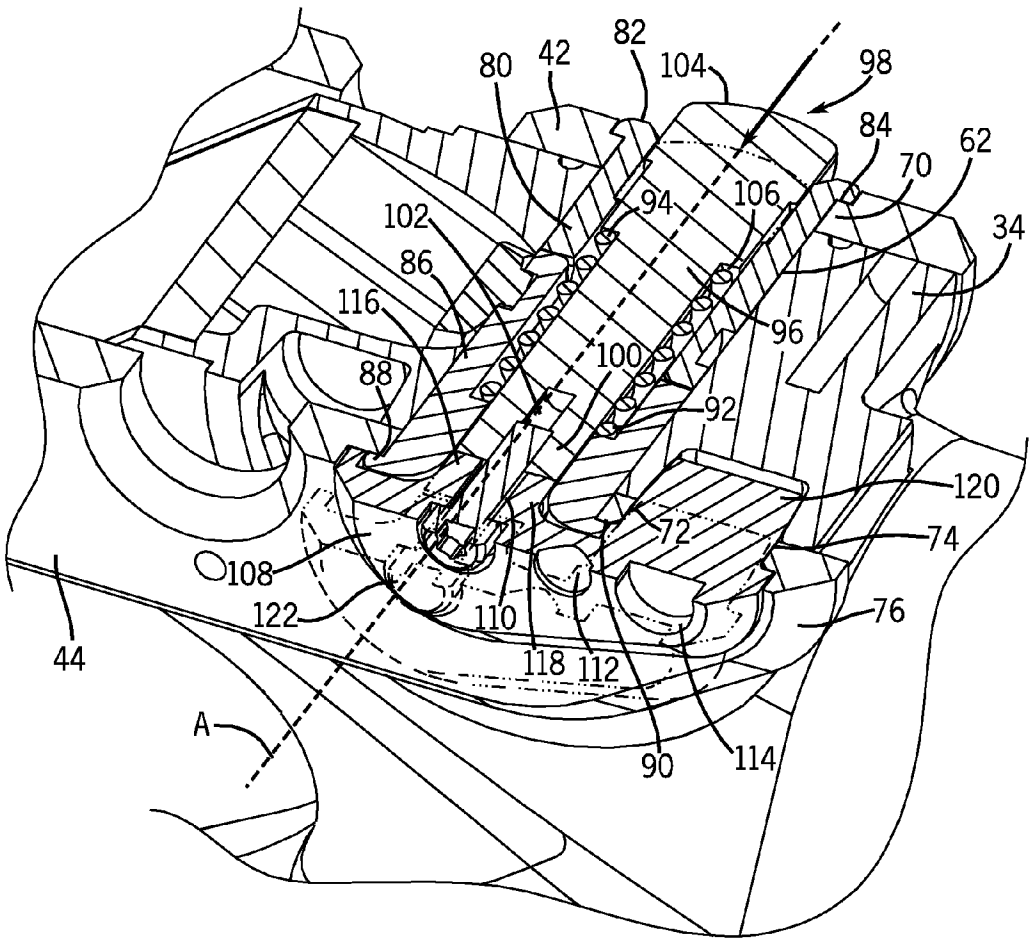
FIG. 4 is an enlarged sectional view taken on line 4-4 of FIG. 2.

Referring to FIGS. 3 and 4, a first tube 80 extends partially through the throughbore 62 of the mounting device 34 and has an enlarged diameter end 82 that is engaged against a recessed surface 84 of the side arm 42. A second tube 86 also extends partially through throughbore 62 and has an enlarged diameter end 88 that is engaged against the recessed surface 90 of the side arm 44. The first and second tubes 80, 86 together define a tube structure having inner ends that abut one another. The second tube 86 is provided with an annular shoulder 92 that functions as a stop for one end of a coil spring 94 which surrounds a reduced diameter portion 96 of a plunger 98 slidably received with the tubes 80, 86. The plunger 98 has an inner end 100 formed with a central blind hole 102, and an enlarged outer end 104 having a shoulder 106 that functions as a stop for an opposite end of the coil spring 94. It should be understood that the first and second tubes 80, 86 could be configured into a single tube, if desired.

Figure 5:
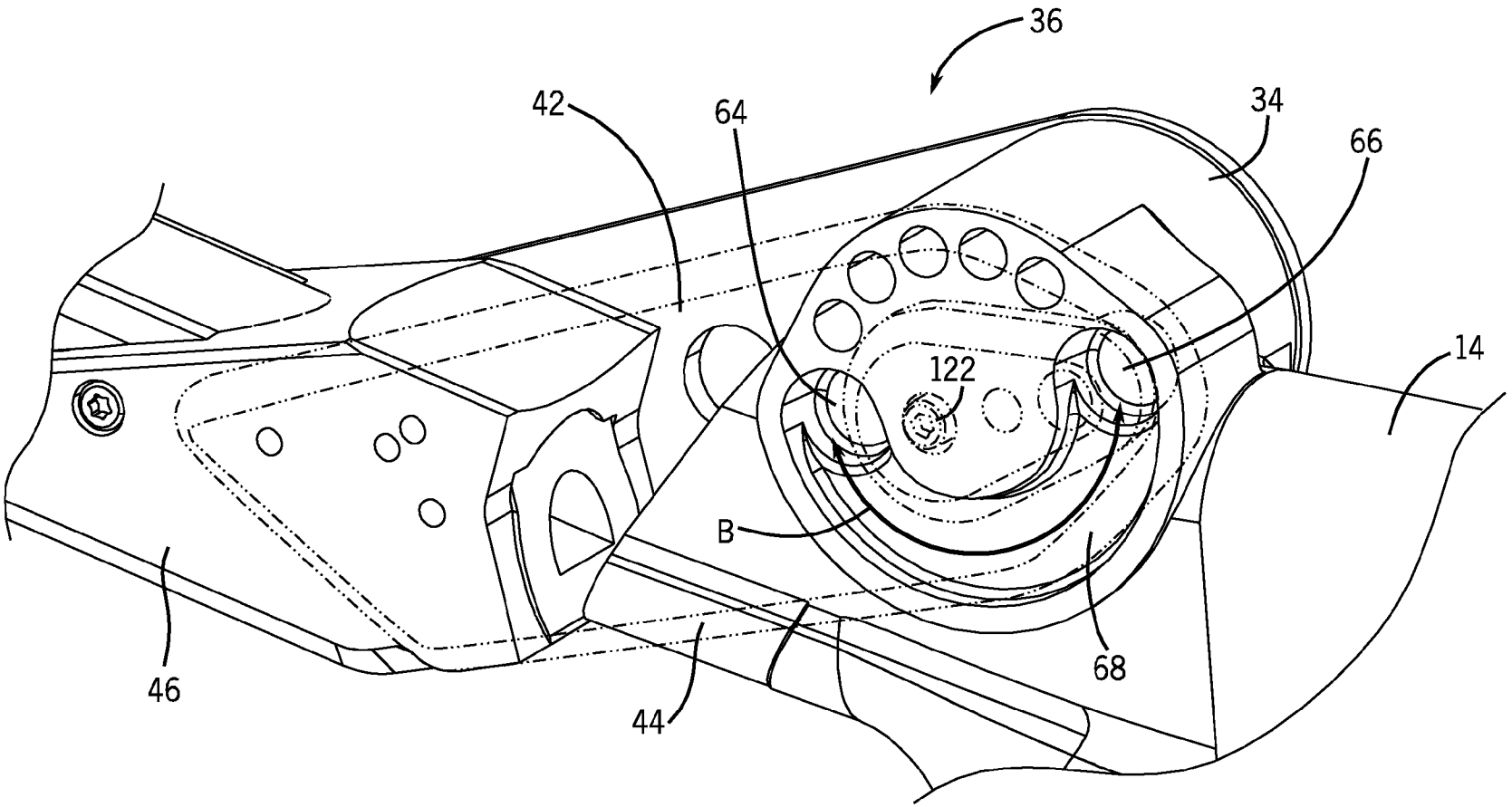
FIG. 5 is a further fragmentary perspective view of the latching arrangement as seen in FIG. 2 showing portions of the over the top stock assembly removed for clarity.

A latch member is positioned on the side arm 44 and is defined by an eccentrically shaped outer portion 108 having a central aperture 110 that is aligned with the blind hole 102 of plunger 98. The outer portion 108 also includes a pair of materially-relieved depressions 112, 114, and a pair of inwardly projecting engagement members 116, 118 that are engageable with the inner end 100 of plunger 98. The outer portion 108 further includes a cylindrical protrusion or latch detent 120 that is eccentrically located relative to the aperture 110 of the latch member 108, extends through hole 74 formed in side arm 44 of pivot stock 36, and is variously engageable with the walls of the cylindrical recesses 64, 66 or cam track 68 over the path B as depicted in FIG. 5. A screw fastener 122 is passed through latch member aperture 110 and is self-threaded into the peripheral wall surrounding the blind hole 102 of plunger 98 to hold the plunger 98 and latch member 108 together.

In the above described construction, the spring 94 normally biases the outer end 104 of plunger 98 outwardly of the external surface of side arm 42 while the detent 120 is captured and held within the surrounding wall of cylindrical recess 64 or 66. Depressing the outer end 104 of plunger 98 against the bias of spring 94 enables release of the detent 120 from recess 64, 66 and allows limited rotation of the pivot stock 36 coupled to the butt stock 38 between the folded and unfolded positions shown in FIGS. 1 and 2. In an exemplary embodiment shown in FIGS. 3-5 and illustrating the unfolded position of stock assembly 10, detent 120 is engaged in cylindrical recess 66. Pushing the plunger 98 inwardly in the direction of arrow C along the horizontal pivot axis A will compress the spring 94 and move the latch member 108 slightly outwardly from the external surface of side arm 44 (as shown in phantom lines in FIG. 4) and disengage detent 120 from recess 66. This will then allow pivotal movement of the pivot stock 36 along with tubes 80, 82, the plunger 98 and the latch member 108 about the horizontal pivot axis A defined by the throughbore 62 of mounting device 34. As the pivot stock 36 turns, the detent 120 moves along the ramped cam track 68 until the detent 120 engages in the wall of recess 64 which defines the folded position of the stock assembly 10. At this point, the latch member 108 moves inwardly toward side arm 44 and the spring 94 will again bias the outer end 108 of the plunger 98 to the position shown in FIGS. 3 and 4. Recess 66 thus defines a first locking position for preventing movement of the stock assembly 10 from the unfolded position while recess 64 defines a second locking position for preventing movement of the stock assembly 10 from the folded position. The disclosure thus provides a combined pivoting and latching arrangement for pivoting selective locking and unlocking of the stock assembly 10 between folded and unfolded positions. The pivoting and latching arrangement is both pivotable about and axially movable along the horizontal pivot axis A.

Referring now to FIGS. 6-10, the butt stock 38 includes a tubular portion 124 having an upper wall 126 and a pair of side walls 128, 130 depending therefrom. The side walls 128, 130 are formed with a number of materially-relieved openings 132 to minimize the weight of the butt stock 38. The tubular portion 124 has an open front end 134 leading to an interior surface which is sized and shaped to matingly, slidably and non-rotatably receive the slide member 48 of the pivot stock 36. The tubular portion 124 has a rear end 136 for pivotably mounting a butt plate 138 thereon by means of a fastener 140 having a pivot shaft 142. The butt plate 138 is designed to be pivoted substantially about a range of 90° between a horizontal storage position shown in FIG. 1, and a vertical shoulder-engaging position shown in FIGS. 2 and 6-10. In the horizontal storage position, the butt plate 138 has an upper end 144 that is engageable with an end section 146 of upper wall 126 in the vertical shoulder engaging position. The butt plate 138 has an inner end 148 (FIG. 10) with an upper portion (not shown) that is engageable with a bottom portion of rear end 136.

A cylindrical recess 150 is formed inside the tubular portion 124 at the end section 146 thereof, the walls forming the recess 150 being utilized to seat one end of a coil spring 152. The spring 152 encircles a first cylindrical protrusion 154 provided on an enlarged rear end 156 of the elongated lever 40, and has an opposite spring end that is retained on a seat 158 surrounding the protrusion 154. A rear portion 160 of the lever 40 including the enlarged rear end 156 thereof is received within a space formed between the bottom surfaces of the side walls 128, 130. A front portion 162 of the lever 40 extends beyond the open end 134 of the tubular portion 124, and includes lock structure defined by a second cylindrical protrusion or lever detent 164 that is variously engaged with one of the forming walls of the detent receiving recesses 54, 56, 58, 60 on pivot stock 36. Between the respective rear and front portions 160, 162, the lever 40 has a pair of laterally projecting ears 166, 168 (FIGS. 6, 7) which are received in cutaway portions of the bottom surfaces of side walls 128, 130. A pivot shaft 170 (FIGS. 8, 9) formed by cooperating joined fasteners 172, 174 passes through aligned holes in the side walls 128, 130 and the ears 166, 168 so that the lever 40 is pivotally mounted to the bottom of the tubular portion 124 between the side walls 128, 130.

Figure 6:
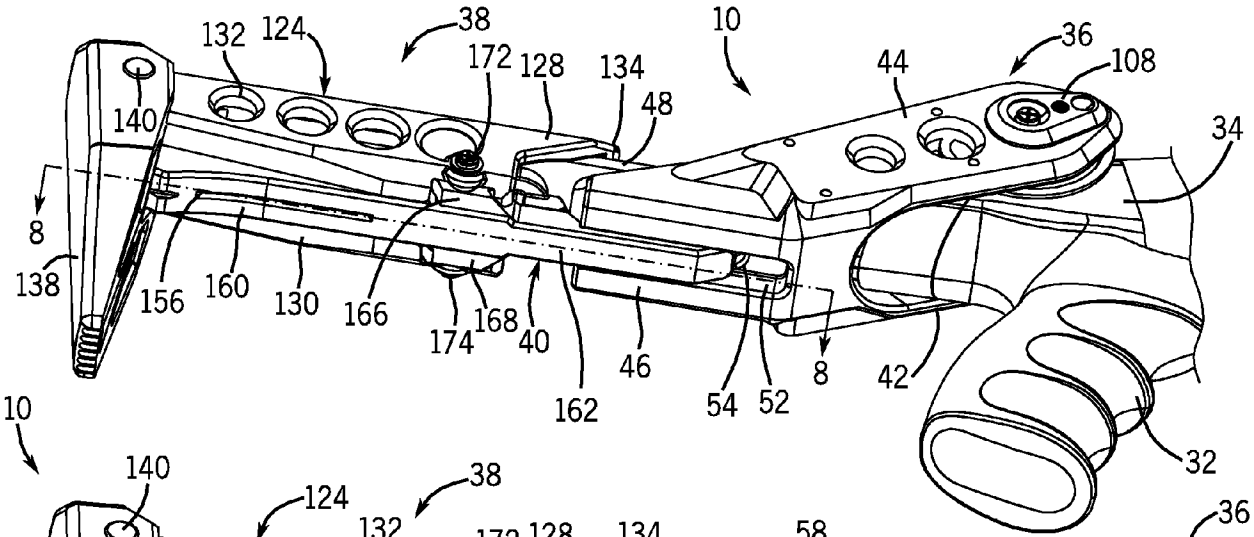
FIG. 6 is a bottom perspective view of FIG. 2.
Figure 8:
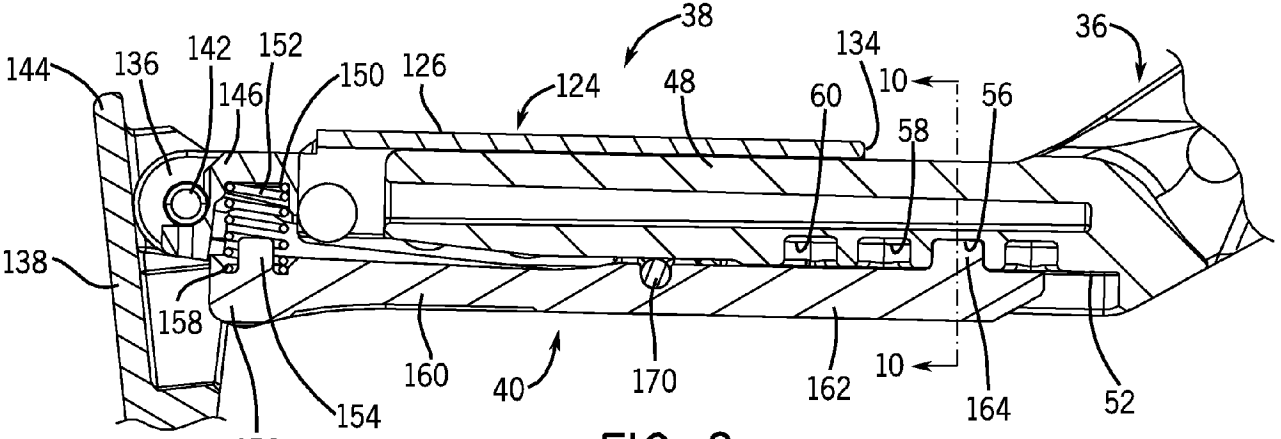
FIG. 8 is a sectional view taken on line 8-8 of FIG. 7.
Figure 9:
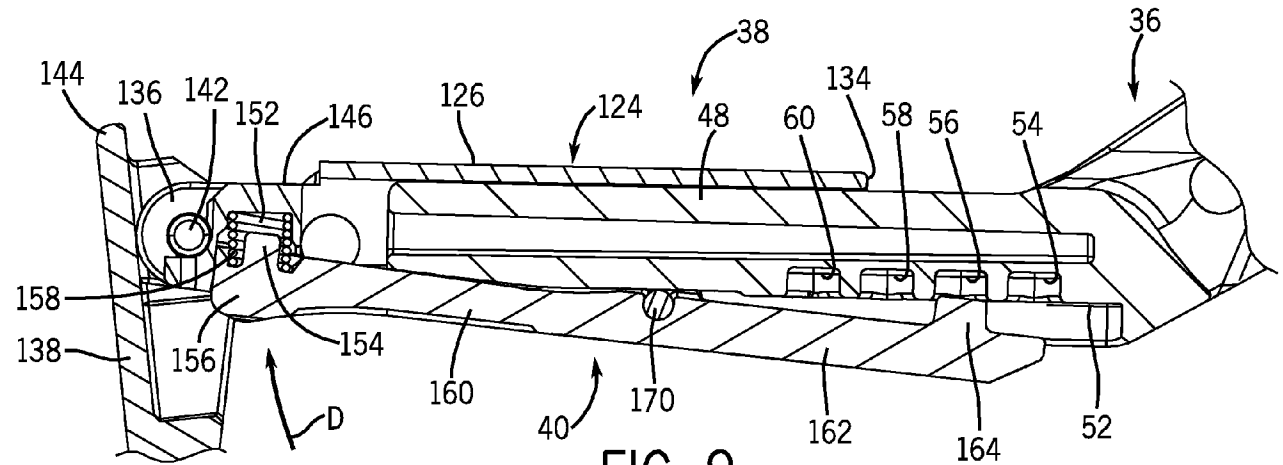
FIG. 9 is a view similar to FIG. 8 illustrating movement of a spring biased lever to effect length adjustment of the over the top stock assembly from a position shown in FIG. 8.
Figure 10:
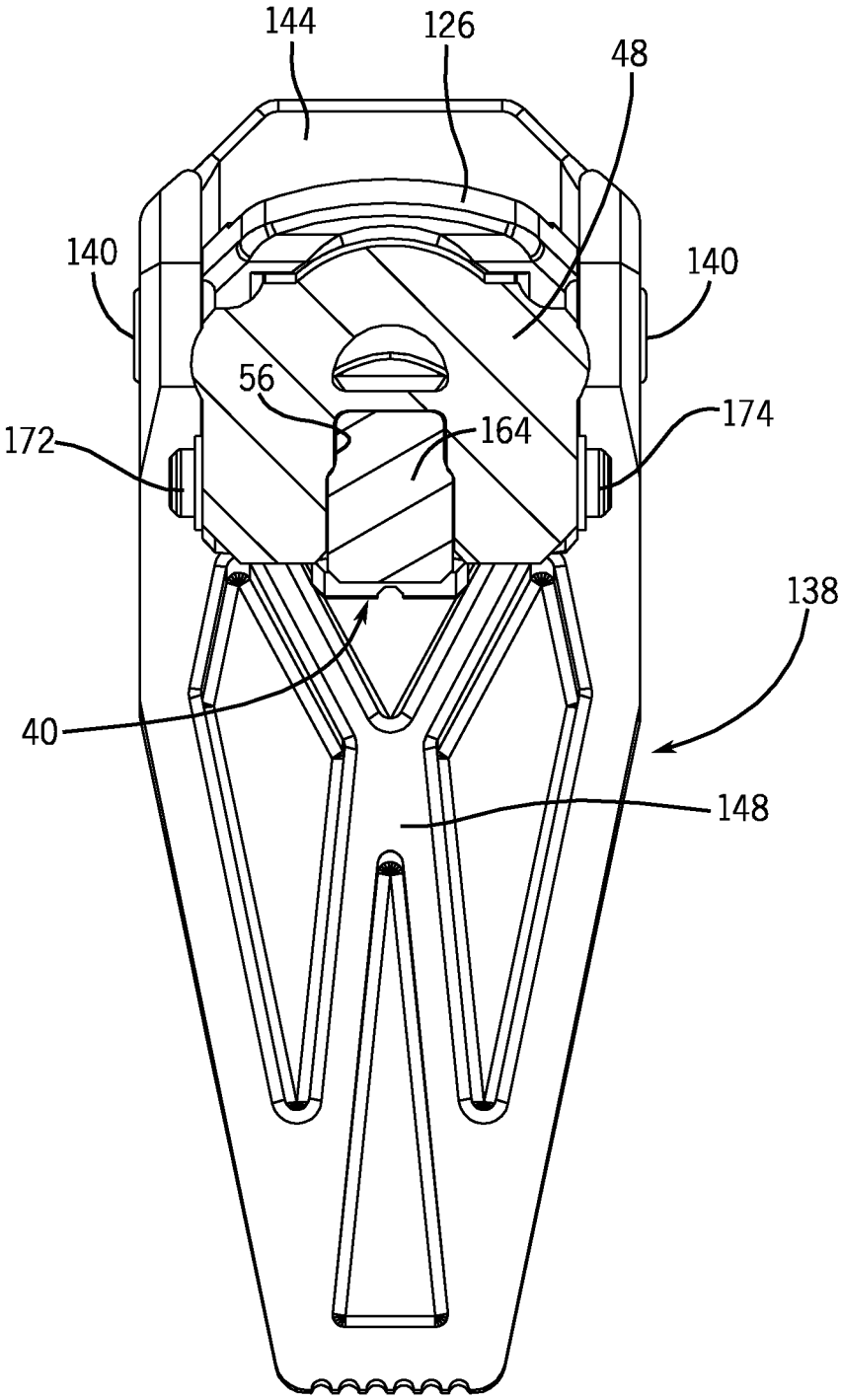
FIG. 10 is a sectional view taken on line 10-10 of FIG. 8.

FIGS. 6-10 illustrate the stock assembly in the unfolded position with the butt stock 38 adjustably positioned axially of the slide member 48 of the pivot stock 36, and the butt plate 138 pivoted to the position for engaging a shooter's shoulder. As seen in FIGS. 6 and 8, the spring 152 functions to normally bias the lever detent 164 into locking engagement with the walls forming the recess 56, and thereby establishes a desired setting or partially extended position of the butt stock 38 relative to the pivot stock 36. Should it become desirous to adjust the length of the butt stock 38 on pivot stock 36, the user pushes on the enlarged end 156 of the lever 40 in the direction of arrow D (FIG. 9). This action compresses the spring 152 and pivots the lever 40 so that the lever detent 164 is released from the walls of recess 56. The user may then slide butt stock 38 in the direction of arrow E (FIG. 7) to another axial adjustment location corresponding to the recesses 54, 58, 60 so as to attain the desired collapsed or fully extended position. If desired, continuous pressure on enlarged end 156 of the lever 40 will enable the butt stock 38 to be slidably removed from the pivot stock 36. Although four recesses 54, 56, 58, 60 are shown illustrating four discrete adjustment positions, it should be understood that any number of recesses could be used to define any desired number of adjustment positions. Releasing pressure on the enlarged end 156 of lever 40 will enable the spring 152 to return the front portion 162 of lever 40 towards the bottom of tubular portion 124 to hold the detent 164 within the walls of the selected recess. When it is desired to reposition the stock assembly 10 to the folded position of FIG. 1, the butt plate 138 is pivoted to its horizontal position, and the combined pivoting and latching arrangement described above is used to unlock the stock assembly 10 so folding may occur.

As should be appreciated, the slidable adjustment between the butt stock 38 and the pivot stock 36 permits users with a range of arm lengths to hold the shotgun 12 comfortably against their shoulder regardless of the length of their arms, or the type or amount of clothing or protective gear worn at the time in the shoulder area.

Various alternatives are contemplated as being within the scope of the following claims particularly pointing out and distinctly claiming the subject matter regarded as the invention.

What is claimed is:

1. A pivotable and length adjustable firearm stock assembly comprising:

a pivot stock having one end provided with a combined pivoting and latching arrangement movable about a horizontal pivot axis and adapted to be pivotally mounted on the rear end of a firearm, and an opposite end provided with a slide member having lock receiving structure;

a butt stock having one end slidably mounted on the slide member, and an opposite end provided with a butt plate pivotally mounted thereto; and a movable member having lock structure thereon interconnected between the pivot stock and the butt stock for locking the butt stock in various axial adjustment positions relative to the slide member of the pivot stock, whereby the pivot stock and the butt stock together are movable about the horizontal pivot axis between a folded position adapted to lie adjacent the firearm and an unfolded position adapted to lie rearwardly of the firearm, and the butt stock is slidably adjustable relative to the pivot stock between various collapsed and extended positions, and wherein the pivoting and latching arrangement includes a tube structure adapted to be positioned in the rear end of the firearm, a plunger slidably inserted for movement in the tube structure along the horizontal pivot axis, the plunger having an outer depressible end accessible from one side of the pivot stock, and an inner end connected to a latch member positioned externally on an opposite side of the pivot stock and provided with a latch detent eccentrically located relative to a control aperture of the latch member and adapted to be engaged on the rear end of the firearm, and a spring disposed and engaged between the tube structure and the plunger and biased to normally hold the latch detent in a desired locking position to prevent movement of the pivot stock and butt stock from the folded and unfolded positions, the latch member being movable externally away from the opposite side of the pivot stock in response to movement of the plunger against the bias of the spring to enable movement of the pivot stock and butt stock from the folded and unfolded positions.

2. The stock assembly of claim 1, wherein the pivoting and latching arrangement is both pivotal about and axially movable about the horizontal pivot axis.

3. The stock assembly of claim 1, wherein the movable member is defined by an elongated lever pivotally mounted on the butt stock having a front portion provided with the lock structure, and an opposite biased rear portion controllable to selectively effect engagement and disengagement of the lock structure relative to the lock receiving structure on the slide member.

4. A pivotable and length adjustable firearm stock assembly comprising:

a pivot stock having one end provided with a combined pivoting and latching arrangement pivotally mounted about a horizontal pivot axis on a rear portion of a firearm, the pivot stock having an opposite end provided with a slide member having lock receiving structure formed thereon;

a butt stock having one end slidably mounted for axial movement on the slide member, and an opposite end provided with a butt plate pivotably mounted thereto; and an elongated lever having lock structure thereon engageable and disengagable with the lock receiving structure on the slide member, the lever being pivotably mounted on the butt stock and having a front portion provided with the lock structure, and an opposite rear portion controllable to selectively effect engagement and disengagement of the lock structure relative to the lock receiving structure so as to enable various axial adjustment positions of the butt stock relative to the pivot stock, wherein a front portion of the lever extends beyond the one end of the butt stock.

5. The stock assembly of claim 4, wherein the lock structure is comprised of a lever detent, and the lock receiving structure is comprised of a set of detent receiving recesses.

6. The stock assembly of claim 4, wherein the rear portion of the firearm includes a pistol grip assembly.

7. The stock assembly of claim 4, wherein the slide member is matingly and non-rotatably received within an interior surface of the butt stock.

8. The stock assembly of claim 4, wherein the rear portion of the lever is located adjacent the opposite end of the butt stock.

9. The stock assembly of claim 4, wherein the lever is pivotally mounted between spaced side walls of the butt stock.

10. The stock assembly of claim 5, wherein a spring is disposed between the rear portion of the lever and the butt stock adjacent the opposite end thereof, the spring being biased to normally hold the lever detent engaged with the one of the detent receiving recesses.

11. The stock assembly of claim 10, wherein movement of the lever against bias of the spring releases the lever detent from the one of the detent receiving recesses, and enables the butt stock to slide upon the pivot stock and the detent to be engaged with another of the detent receiving recesses.

12. A firearm stock assembly comprising:

a pivot stock having one end provided with a combined pivoting and latching arrangement pivotally mounted about a horizontal pivot axis on a rear portion of a firearm, the pivot stock having an opposite end with a fixed mounting member projecting therefrom; and a butt stock attached to the fixed mounting member, the pivot stock and the butt stock together being movable about the horizontal pivot axis between a folded position lying adjacent the firearm and an unfolded position extending rearwardly of the fireman, wherein the rear portion of the firearm includes latch engaging structure cooperable and continuously engageable with a latch member of the pivoting and latching arrangement as the pivot stock and butt stock move together about the horizontal pivot axis to define a first locking position for preventing movement of the pivot stock and the butt stock from the folded position, and a second locking position for preventing movement of the pivot stock and the butt stock from the unfolded position, wherein the latch engaging structure is defined by a pair of latch engaging recesses interconnected by a grooved track for guiding the latch member between the latch engaging recesses, and wherein the track has a ramped cam surface that slopes between the pair of latch engaging recesses.

13. The stock assembly of claim 12, wherein one of the latch engaging recesses defines the first locking position, and the other of the latch engaging recesses defines a second locking position.

14. The stock assembly of claim 12, wherein the track defines a curved path that is concentric relative to the horizontal pivot axis.

15. The stock assembly of claim 12, wherein the rear portion of the firearm includes a throughbore having the horizontal pivot axis passing therethrough, and the one end of the pivot stock includes a pair of spaced apart side arms engaged with side surfaces of the rear portion and having holes in registration with the throughbore.

16. The stock assembly of claim 15, wherein the latch member is positioned on one of the side arms and includes a latch detent eccentrically located relative to a central aperture of the latch member.

17. The stock assembly of claim 16, wherein the pivoting and latching arrangement includes a tube structure positioned in the throughbore, a plunger slidably inserted for movement in the tube structure along the horizontal pivot axis, the plunger having an outer depressible end accessible from the other of the side arms, and an inner end connected to the latch member positioned on the one of the side arms, and a spring disposed between the plunger and the tube structure and biased to normally hold the latch detent in one of the first and second locking positions.

18. The stock assembly of claim 17, wherein movement of the plunger along the horizontal pivot axis against bias of the spring moves the latch member away from the side arm, and releases the latch detent from the one of the first and second locking positions allowing the pivot stock connected to the butt stock to pivot about the horizontal pivot axis and the latch detent to travel along the track towards the other of the first and second locking positions.

* * * * *